United States Patent [19]

Robertson

[11] Patent Number: 4,850,487

[45] Date of Patent: Jul. 25, 1989

[54] CABLE REEL COVER

[75] Inventor: Desmond Robertson, Kilmore, Australia

[73] Assignee: Manufacturing Industries Corporation Pty. Ltd, Sydney, Australia

[21] Appl. No.: 213,706

[22] Filed: Jun. 30, 1988

[30] Foreign Application Priority Data

Sep. 21, 1987 [AU] Australia ..... PI4476

[51] Int. Cl.[4] ..... B65D 85/66

[52] U.S. Cl. ..... 206/399

[58] Field of Search ..... 206/398, 399, 400

[56] References Cited

U.S. PATENT DOCUMENTS 2,763,056 9/1956 Kimmel ..... 206/399 X 2,831,299 4/1958 Keeble ..... 206/399 X

*Primary Examiner*—William Price

*Attorney, Agent, or Firm*—Michael, Best and Friedrich

[57] ABSTRACT

A protective cover for cable reels comprising a plurality of battens that are linked together in a parallel array by two spaced apart flexible straps that may be secured by either to the outside or underside of the battens. The straps may be tensioned to hold the cover over the periphery of the cable reel. Alternatively, separate steel bands are used on the exterior of the array to hold the array in tension on the reel. In one embodiment, the flexible straps are in the form of ropes positioned on the underside of the array to centrally locate the array on the reel.

8 Claims, 3 Drawing Sheets

CABLE REEL COVER

This invention relates to a protective cover for cable reels.

INTRODUCTION

Cable reels for use with large industrial cables conventionally comprise a wooden or steel drum that spans circular side portions conventionally made of wood. The cable is wound onto the drum to a level approximately 80 mm below the periphery of the sides. Although the sides of the reel provide a certain amount of protection for the cable, there is a danger that when the reel is rolled on the ground over rocky terrain that rocks or other projections will damage the outer coils of the cable. Thus, it is common practice to protect the cable by nailing wooden battens across the reel against the periphery of the wooden sides. This is a labour intensive exercise which suffers from the further disadvantage that, in use, the wooden battens are removed by a crow-bar and then discarded. Whilst the battens may be used as firewood, they cause a potential hazard in that they are frequently left lying around with nails protruding from each end.

The expense of the cable reels results in a demand for the return of the cable reels for re-use. However, the placing of the nails in the periphery of the sides of the cable reel damages the structure of the sides and makes it difficult to nail on another set of battens when the reel is re-used. Thus, the cable reels quickly become damaged and have to be discarded.

It is these problems that have brought about the present invention.

SUMMARY OF THE INVENTION

According to the present invention there is provided a protective cover for cable reels comprising a plurality of battens linked together in a parallel array by at least one flexible strap that is secured to each batten, and means to hold the cover in tension over the periphery of a cable reel.

Preferably the plurality of battens are linked together by two flexible straps spaced apart and attached to each batten.

In one embodiment each flexible strap is secured to the outside of the array of batten with a groove formed in the exterior surface of each batten.

Preferably each strap has a free end sufficiently long to enable the strap to be wrapped twice around the reel and tensioned by use of a buckle.

Each batten may be provided with a rebate at the underneath of each end to centrally locate the cover against the reel.

In a preferred embodiment the flexible straps comprise two lengths of rope secured to the underside of each batten at a position spaced inwardly from each end of the batten so that in use the ropes locate against the inside surface of the sides of the cable reel to centrally locate the protective cover onto the periphery of the reel.

Preferably the means to hold the cover in tension over the periphery of the cable reel comprises at least one steel band arranged to be wrapped around the periphery of the protective cover, the overlapping ends of the band being held in tension by a buckle.

DESCRIPTION OF THE DRAWINGS

Various embodiments of the present invention will now be described by way of example only with reference to the accompanying drawings in which.

DESCRIPTION OF EMBODIMENTS

Figure 1:
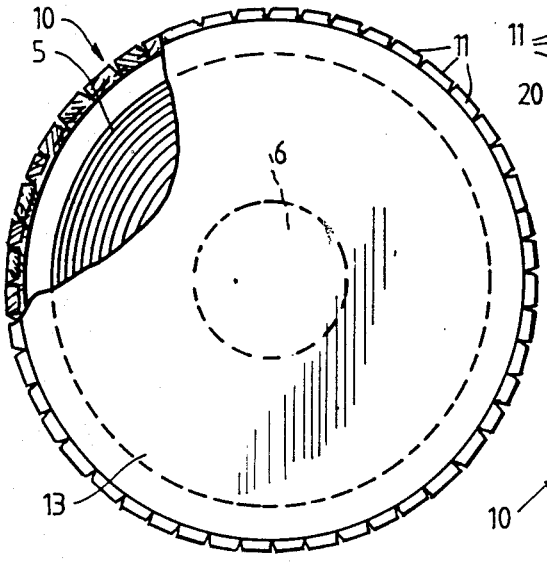
FIG. 1 is a side-on view of a cable reel with a protective cover attached thereto.

The cable reel illustrated in the accompanying drawings comprises a central cylindrical spool 6, bounded on each side by circular side portions 9, 13, one of which 13 is illustrated in FIG. 1. The spool 6 and side portions 9, 13 are conventionally made of wood and a cable 5 is wound on to the drum to a height that is approximately 80 mm below the outer periphery of the side portions. A protective cover 10 comprises a plurality of wooden battens 11 of rectangular cross-section that are joined together in a parallel array by various types of flexible straps that are stapled to each batten.

In use the cover 10 is wrapped around the periphery of the drum 6 with the ends 16, 17 of each batten 11 abutting respectively the outer edge of the side portions 9 and 13. Thus the length of each batten is selected so that the batten spans the reel. The length of the array is selected so that when the cover is wrapped around the reel, opposite ends of the array are either in abutting contact or are very close to one another. Various types of tensioning means are then employed to hold the cover against the reel periphery.

Figure 2:
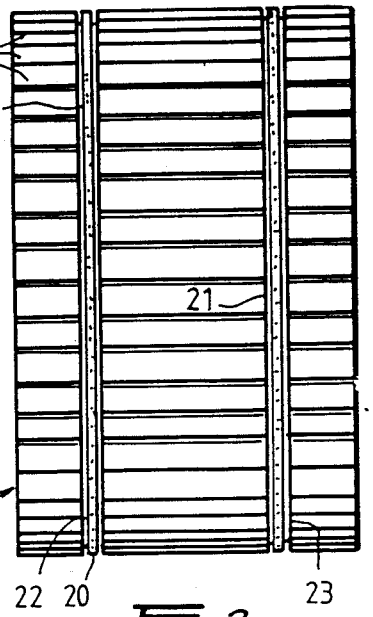
FIG. 2 is an end-on view of the reel shown in FIG. 1.
Figure 3:
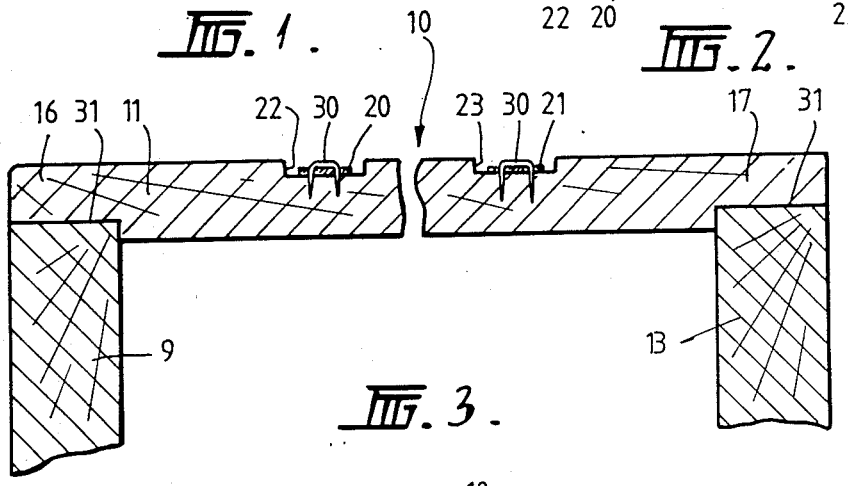
FIG. 3 is a partial cross-sectional view of the top of a covered cable reel illustrating one embodiment of the invention.

In a first embodiment illustrated in FIGS. 1 to 3, the array of battens 11 that is held together by two polyester straps 20 and 21 that are positioned along the length of the array of battens within a pair of slots 22 and 23 that are formed spaced apart in the outer surface of each batten. When the battens are held together in the array as shown in FIG. 2, the slots 22 and 23 form elongate parallel grooves into which the flexible straps are located so that the straps 20, 21 do not project outwardly of the outer surface of the battens. The straps are held within the slots 22,23 by use of two-way twist staples 30. The underside of each end 16 and 17 of each batten 11 is provided with a rebate 31 arranged so that each batten is a close abutting fit onto the ends of the side portions 9 and 13 of the cable reel. The rebates 31 act to centrally locate the cover onto the periphery of the reel. In this embodiment, the polyester straps are considerably longer than the length of the array so that as the array is wrapped around the reel until the battens at opposite ends meet, the flexible straps can then be wrapped at least once more around the assembly to be tensioned thereon by use of a suitable buckle and tensioning means (not shown) that is secured to the ends of the straps. In this manner, each flexible strap 20 or 21 is tensioned so that the whole array is firmly located against the reel.

Figure 4:
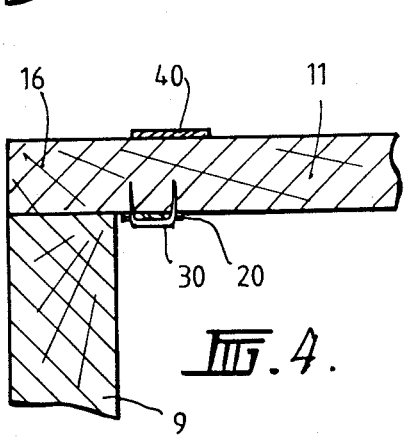
FIGS. 4 and 5 are partial cross-sectional views similar to FIG. 3 illustrating two further embodiments of the invention.
Figure 6:
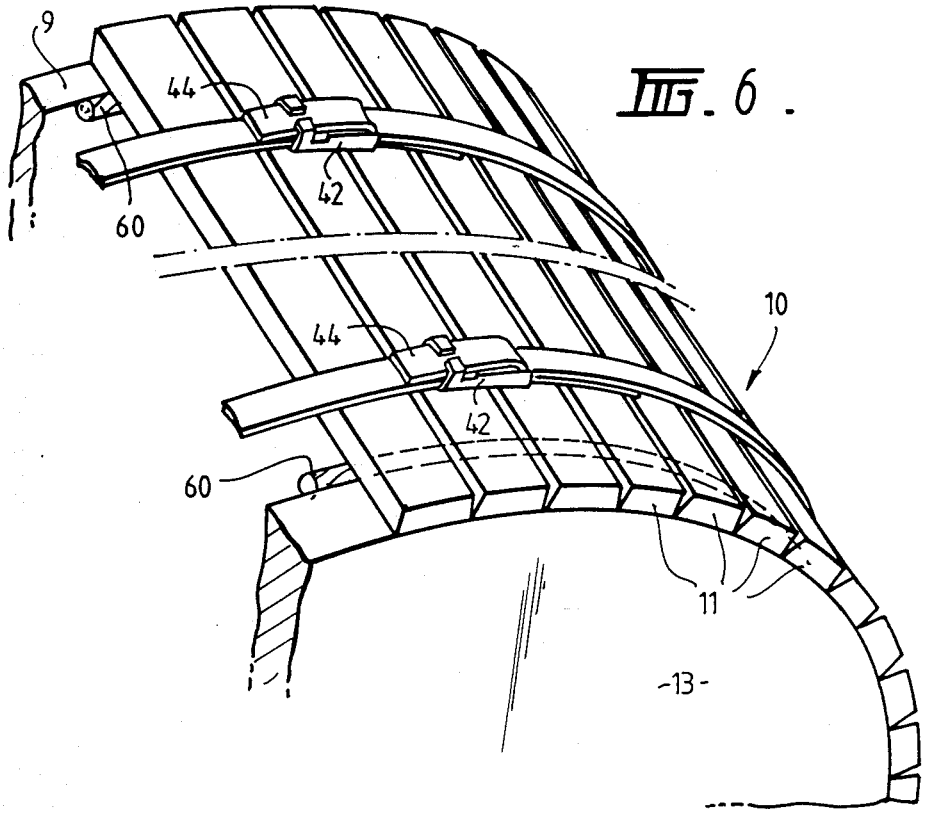
FIG. 6 is a part perspective view of the assembly shown in FIG. 5.
Figure 9:
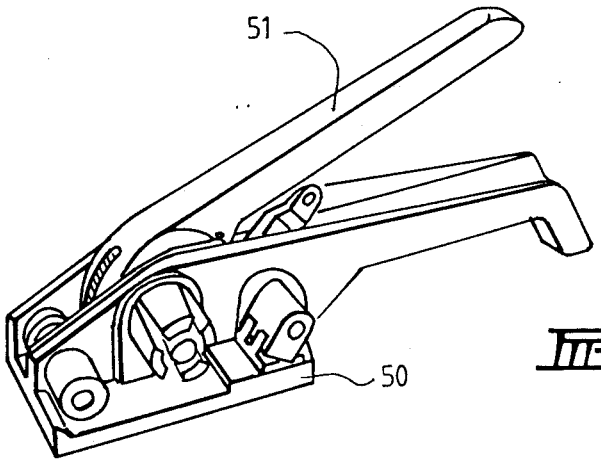
FIG. 9 is a perspective view of a band tensioning device for use with the embodiments of Figures 4 and 5.
Figure 7:
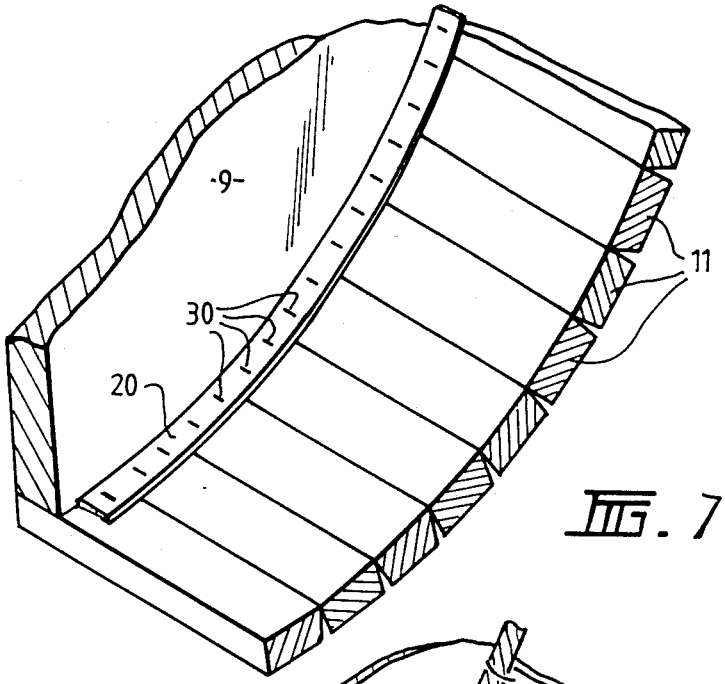
FIGS. 7 and 8 are part perspective views of the outerside of the assembly shown in FIGS. 4 and 5 respectively.

In the embodiment illustrated in FIGS. 4 and 7, the flexible straps 20 and 21 are not positioned on the exterior surface of each batten 11 but are attached to the underside of each batten by staples 20. The flexible straps 20, 21 are positioned inwardly of the ends 16 and 17 of the battens adjacent the inner surface of the side portions 9 and 13 of the reel. In this embodiment, the length of the flexible strap is the same as the length of the array so that the straps merely keep the battens together. The tensioning of the assembly is carried out by use of a pair of steel bands 40 and 41 that are positioned around the exterior of the assembly and tensioned thereon by means of a tensioning member 50 illustrated in FIG. 9. The tensioning member 50 grips the overlapping ends of the band 40 or 41 and by a number of depressions of the handle 51 pulls the band taut. As shown in FIG. 6, the overlapping end 44 is pulled back on itself and held in clamped engagement by a buckle 42. It is understood that the metal straps and tensioning member 50 are well known proprietary items used in the packaging and transportation industry. The pair of straps firmly locate the assembly with the ends of each batten in firm abutting contact against the side portions.

Figure 5:
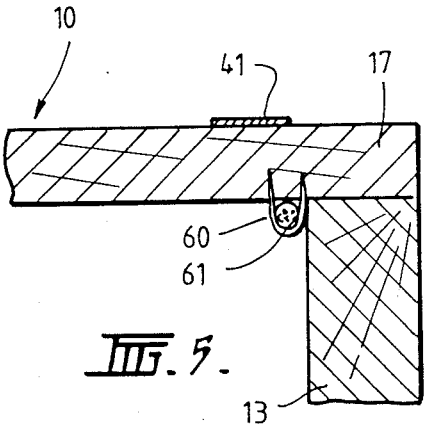
Figure 8:
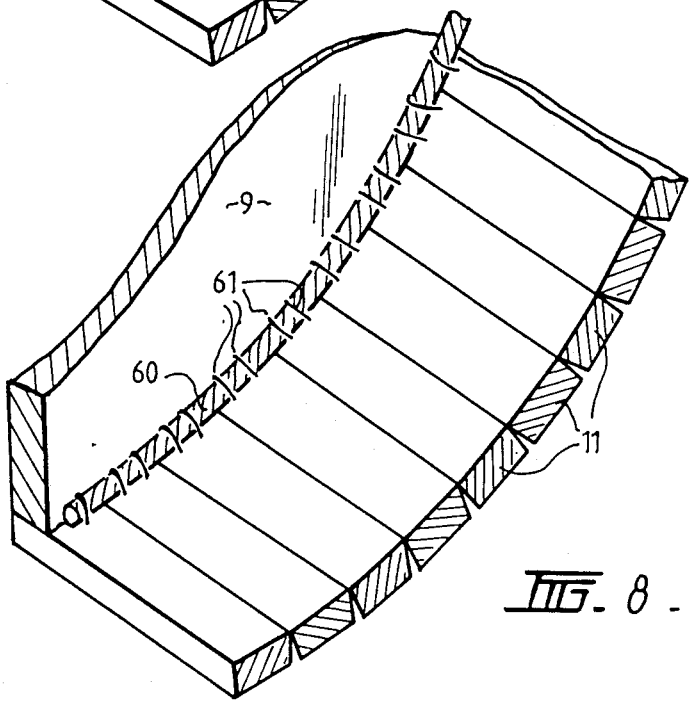

In the embodiment illustrated in FIGS. 5, 6 and 8, each flexible strap is replaced by a length of rope 60 that is secured adjacent each end 16, 17 of the underside of the batten by suitable U-shaped staples 61. The rope is positioned inwardly of the ends of the batten at a position adjacent the interior surface of the side portions 9 and 13 so that the rope acts as a location means centrally positioning each batten against the exterior of the cable reel. Thus, the rope serves not only to hold the battens in a parallel array but serves in the same manner as the rebates 31 at the ends of the battens as illustrated in FIG. 3 to locate the array centrally on the reel. As in the embodiment illustrates in FIGS. 5 and 7, a pair of steel bands 40 and 41 are positioned on the exterior of the cover to tension the cover and hold it in firm engagement on the reel.

In all the embodiments described above, the flexible straps hold the battens in a parallel array so that when the cover is wrapped around a drum, the inner edges of each batten are in either abutting contact or virtual abutting contact as shown in FIGS. 7 and 8. Once the cover has been tensioned onto the cable reel, the exterior of the cable reel is thus totally covered and the cable contained on the reel is protected from damage during transportation and on site delivery, storage and use.

The reusability of the cover is a particularly advantageous feature. When a cable reel is delivered to a particular site, the tensioning means is released by either removing the steel bands or undoing the overlapping ends of the flexible straps., It is then a simple matter to unwrap the cover member which can then be rolled into a small bundle for return with the empty reel. When the spent reel is returned and more cable is wound onto the spool, the protective cover can be unrolled, wrapped around the drum and tensioned by use of either two new steel bands or reuse of the extended length of the flexible straps. The rebates on the ends of the battens or the position of the ropes, centrally position the cover and ensure that each time the cover is used, the cover is firmly attached to the periphery of the reel. There is no need for fasteners such as nails or screws and thus, the side portions of the reel do not become damaged when the cover is attached and detached from the reel.

The cover is made by simple means using readily available materials and it is considered to be a substantial advance over the existing methods of protecting cable reels.

The battens may be constructed of soft or hard wood and are, in the preferred embodiment, 100 mm wide by 24 mm deep. The length of the batten varies in dependence with the width of each reel. It is however understood that the size and shape of the battens may vary to suit particularly customers. Furthermore the cover is designed to be used on reels of varying diameters up to and including reels of 3 metre diameter.

The polyester strapping is, in the preferred embodiment, 19 mm wide and is commercially available in two breaking strengths, namely 600 kg and 950 kg.

Various modifications and variations may be made to the assembly described herein without departing from the broad scope of the invention as defined in the claims appended hereto.

Having now described my Invention, What I claim is:

1. A protective cover for cable reels comprising a plurality of battens linked together in parallel array by at least two flexible straps that are secured spaced apart to the underside of each batten, and means to hold the cover in tension over the periphery of a cable reel.

2. The protective cover according to claim 1 wherein the flexible straps comprise two lengths of rope secured to the underside of each batten at a position spaced inwardly from each end of the batten so that in use the ropes locate against the inside surface of the sides of the cable reel to centrally locate the protective cover onto the periphery of the reel.

3. The protective cover according to claim 1 wherein one end of each length of rope is arranged to be secured to the inside of one side of the cable reel.

4. The protective cover according to claim 1, wherein the means to hold the cover in tension over the periphery of the cable reel comprises at least one steel band arranged to be wrapped around the periphery of the protective cover, the overlapping ends of the band being held in tension by a buckle.

5. A protective cover according to claim 1, wherein each batten is provided with a rebate at each end.

6. A protective cover according to claim 1, wherein each flexible strap is stapled to each batten.

7. The protective cover according to claim 1, wherein the battens are made of wood.

8. A cable reel assembly comprising a cable reel having a central spool bounded on each side by circular side portions, the spool being arranged to accommodate a roll of cable or wire wrapped around the spool to a height below the level of the side portions, a protective cover according to claim 1 arranged to be wrapped around and tensioned onto the periphery of the reel against the periphery of the side portions of the reel to protect the cable or wire on the spool.

* * * * *

UNITED STATES PATENT AND TRADEMARK OFFICE

CERTIFICATE OF CORRECTION

PATENT NO. : 4,850,487

DATED : July 25, 1989

INVENTOR(S) : Desmond Robertson

It is certified that error appears in the above-identified patent and that said Letters Patent is hereby corrected as shown below:

Column 4, line 39, delete "claim 1" and insert --claim 2--.

Signed and Sealed this

Twenty-fourth Day of July, 1990

*Attest:*

HARRY F. MANBECK, JR.

*Attesting Officer*

*Commissioner of Patents and Trademarks*